United States Patent [19]

Coe

[11] 4,136,473

[45] Jan. 30, 1979

[54] MANUALLY ADJUSTABLE INDICATING DEVICE

[75] Inventor: Stanley S. Coe, Raleigh, N.C.

[73] Assignee: The Mead Corporation, Dayton, Ohio

[21] Appl. No.: 802,441

[22] Filed: Jun. 1, 1977

[51] Int. Cl.[2] ..... G09F 11/18

[52] U.S. Cl. ..... 40/518; 40/109; 40/117; 40/385

[58] Field of Search ..... 40/107, 109, 110, 116, 40/117, 120, 358, 385, 375, 491, 514, 518, 16, 16.2, 904

[56] References Cited

U.S. PATENT DOCUMENTS

| | | | |
|---|---|---|---|
| 700,059 | 5/1902 | Lichter | 40/109 |
| 1,462,015 | 7/1923 | Leitch | 40/16.2 |
| 3,016,638 | 1/1962 | Singer | 40/16 |

*Primary Examiner*—Louis G. Mancene
*Assistant Examiner*—G. Lee Skillington
*Attorney, Agent, or Firm*—Walter M. Rodgers; Walter A. Rodgers

[57] ABSTRACT

A manually adjustable indicating device such as a wall or desk calendar, a price board or the like includes a housing structure having a central flat base plate with overturned side edges defining a storage cavity on each side of the base plate together with support plate means slidable into the housing structure between a pair of spaced guides formed along the side edges of the flat base plate and a plurality of spaced apart flanged ribs formed on the support plate so as to receive the edges of a self-coiling tape and thereby to hold that portion of the tape which is adjacent the support plate means in flat face contacting relation therewith and so as to allow the coiled ends of each tape to occupy the storage cavities on each side of the base plate, each tape having visually observable indicia thereon which may be changed by simple manual finger touch whereby the portion of the tape which is exposed is moved and whereby one end of the tape is uncoiled and the other end is coiled.

8 Claims, 4 Drawing Figures

MANUALLY ADJUSTABLE INDICATING DEVICE

Scroll-like tapes or sheets are known in which adjustments may be made so as to change the observable indicia. Ordinarily such known structures include viewing areas of arcuate configuration which may be difficult to read particularly under certain adverse lighting conditions.

Other known structures of the scroll type utilize a housing in which a translucent window is formed and which may serve to hold the observable portion of the scroll or tape in flat condition. Such translucent surfaces frequently are convex in nature and of course may render the indicia difficult to read particularly where light reflection is a factor or where the translucent material is of a convex cross-sectional configuration which may tend to detract from easy and comprehensive reading due to diffraction or other factors.

According to this invention in one form, housing structure having a flat base plate on the side edges of which a pair of guides are formed and from which overturned edges depend is provided with a support plate having spaced apart projecting ribs and associated flanges arranged so as to receive in overlapping relationship the side edges of one or more self-coiling tapes, the support plate being arranged with respect to the housing structure so that the coiled ends of the tape may be stored within storage cavities along the opposite edges of the base structure. According to a feature of the invention the guides which are disposed alongside the support plate means are of such height as frictionally to engage the adjacent parts of the tapes and preferably so as to impart a slight bend thereto and thereby to secure each tape in a desired position against possible undesired movement due to environmental effects such as vibration and the like.

While the invention is not limited to desk or wall calendars it is well suited for use in connection with such devices and in the drawings the invention is shown as applied to a desk calendar.

For a better understanding of the invention reference may be had to the following detailed description taken in conjunction with the accompanying drawings in which FIG. 1 is an isometric view of a desk calendar formed according to one form of the invention;

FIG. 3 is an enlarged cross-sectional view taken along the line designated 3—3 in FIG. 1; and in which

Figure 3:
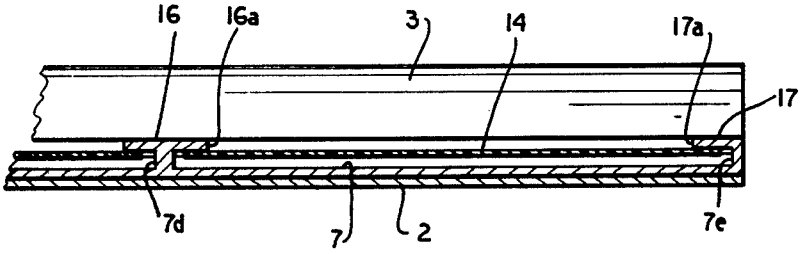

In the drawings the numeral 1 generally designates housing structure having a flat base plate 2 to the bottom and top edges of which a pair of storage cavities 3 and 4 depend. These storage cavities simply constitute overturned side edges of the elongated base plate 2. A pair of guides 5 and 6 are formed along the top and bottom edges of base plate 2. Support plate means generally designated by the numeral 7 includes a flat planar surface to which a plurality of ribs are secured such as are designated at **7*a* and 7*b* and to the outer edges of which a plurality of flanges 8 and 9 are secured. Ribs 7*d* and 7*e* are shown in FIG. 3 and flanges 16 and 17 are secured to or form parts of ribs 7*d* and 7*e* respectively. Rib 7*d* and flange 16 are of T-shaped cross-sectional configuration while rib 7*e* and flange 17 are of L-shaped cross-sectional configuration as is apparent in FIG. 3. A rib associated with flange 15 is not observable in the drawings. A plurality of self-coiling tapes generally designated at 11, 12, 13 and 14 are mounted on the support plate means 7 and arranged so that their edges are disposed underneath the adjacent flange. For example edge 12*a* is disposed underneath the overlying portion 9*a* of flange 9. A self-coiling tape 11 is mounted with one of its edges under the overlying portion 8*a* of flange 8 and with its opposite edge portion underlying the portion 9*b* of flange 9. From FIGS. 3 and 4 it is apparent that the tape such as 14 is arranged so that its left hand edge as viewed in FIG. 3 is disposed underneath and in overlapping relation with respect to the side portion 16*a* of flange 16 while the right hand edge of tape 14 is disposed underneath the overlying portion 17*a* of flange 17**.

It is by means of these ribs and flanges that the part of each tape which is disposed adjacent the associated part of the support plate 7 is maintained in flat readily observable condition.

In order to change a reading, it is simply necessary to engage any one of the tapes such as 14 for example with a light finger touch and to impart movement to the tape in the desired direction so as to change the observable indicia on that tape.

Figure 1:
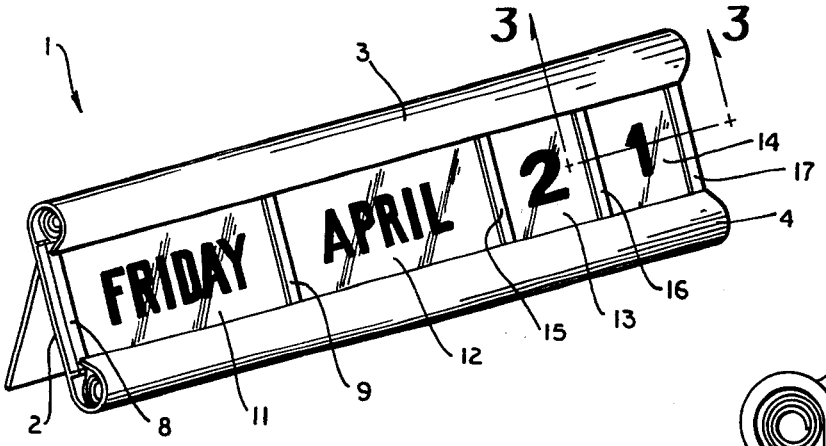
Figure 2:
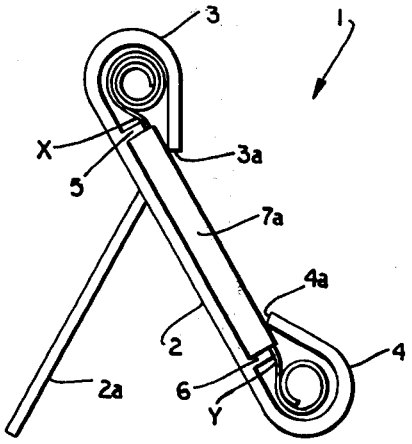
FIG. 2 is an end view of the structure shown in FIG. 1.

In order to insure that all of the tapes remain in fixed but adjustable position as may be desired, the guides 5 and 6 are arranged to project a sufficient distance from the edges of base plate 2 so as to cause a slight bend in all of the tapes as is apparent in FIG. 2 at the points designated X and Y. This bend not only tends to increase the frictional relationship between all of the tapes and the ribs such as 5 and 6, it also inherently tends to secure the tapes in position once a particular position is determined.

The inturned edges such as **3*a* and 4*a* of the overturned parts of the base plate 2 are disposed in close proximity to the exposed outer surfaces of the flanges 8, 9, 15, 16 and 17 as is particularly apparent from FIG. 2 which shows the rib 7*a* and its associated flange 8 as these parts appear from the end view. Clearance passages between the edges 3*a* and 4*a* and the parts of support plate 7** between the ribs receive the tapes.

Figure 4:
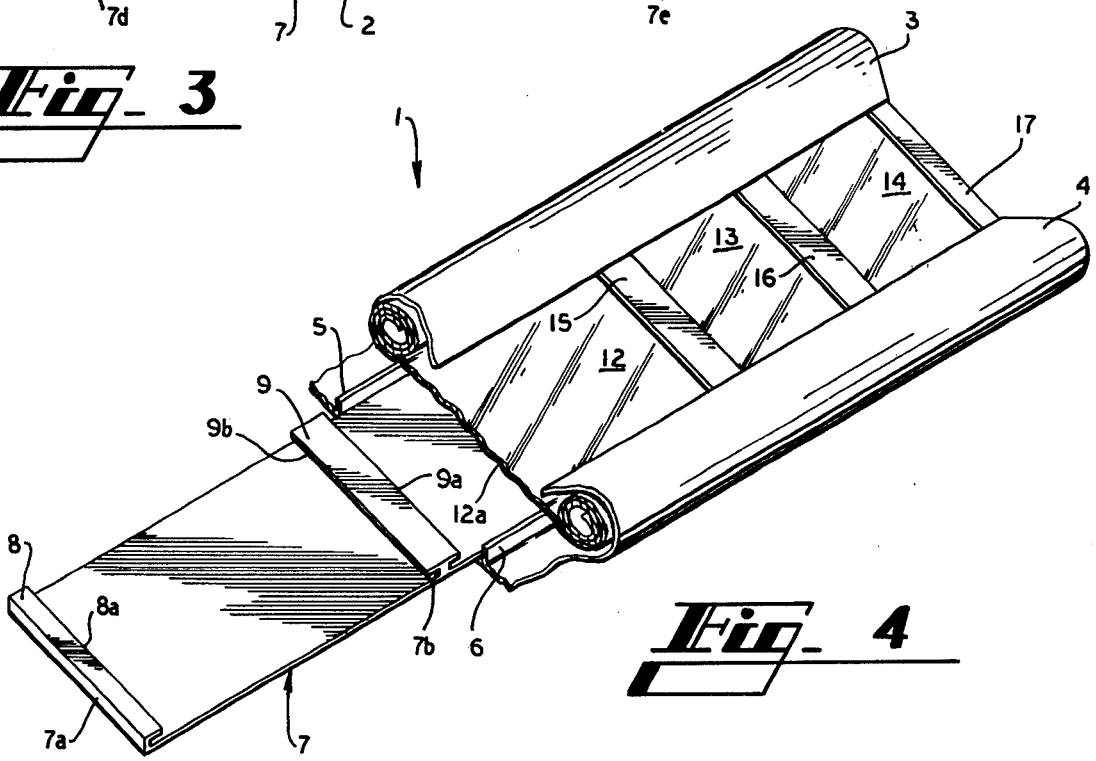
FIG. 4 is a view of structure such as is shown in FIG. 1 but with the near end of the housing and a part of one tape broken away and with the near tape removed for clarity.

In order to assemble the device, the tapes may be partially uncoiled with convolutions at each end and then inserted into the holder as indicated at 12, 13 and 14 in FIG. 4 after which the support plate 7 may be inserted between the ribs 5 and 6 and in parallel relationship to the base plate 2 and underneath the exposed parts of all the tapes. After the support plate 7 is completely inserted within the housing structure 1, the edges of the tapes may then be manually positioned underneath the adjacent edges of the flanges 8, 9, 15, 16 and 17 as is obvious.

For some applications of the invention it may be desirable to mount the exposed portions of the tapes onto the support plate means and then to insert the plate means 7 and all of the tapes endwise into the housing structure. The choice of an assembly method ordinarily is determined by the size of the display, the thickness and coiling tendency of the tapes together with the facilities available for assembly. Obviously the invention is not limited to any particular assembly method.

While the invention is shown in conjunction with a desk calendar whose housing structure is propped in viewing position by the bracket **2*a***, it will be understood that other means may be used for mounting the housing structure and associated parts such for example as suitable known wall mounting means.

The embodiments of the invention in which an exclusive property or privilege is claimed are defined as follows:

1. A manually adjustable indicating device comprising a housing structure having a substantially flat base plate and a pair of storage cavities secured to opposite side edges of said base plate, a support plate slidably mounted in said housing structure in parallel relation to said flat base plate and having at least one pair of horizontally spaced transversely disposed ribs to the outer edges of which a pair of flanges are secured, and a self coiling tape having its coiled ends disposed respectively in said storage cavities and having an intermediate portion arranged in flat face contacting relation to said base plate and with its side edges underneath said flanges, said tape having visually observable indicia thereon.

2. A device according to claim 1 wherein said storage cavities comprise overturned side edges of said base plate arranged to define a clearance passage for said tape which is between said ribs and flanges.

3. A device according to claim 2 wherein the extremities of said overturned side edges are disposed in close proximity to said flanges.

4. A device according to claim 1 wherein a pair of longitudinally disposed transversely spaced guides are secured to said flat base plate and disposed alongside the side edges of said support plate.

5. A device according to claim 4 wherein said guides are normally in contact with said tape and in frictional relation therewith.

6. A device according to claim 5 wherein the tape contacting edges of said guides are spaced from said base plate outwardly relative to the tape contacting surfaces of said flanges so as to impart slight bends to the tape.

7. In a manually adjustable indicating device, an elongated support plate having a flat planar surface, a plurality of longitudinally spaced transversely disposed ribs on said support plate, a plurality of flanges on the edges of said ribs remote from said support plate respectively, the end ones of said ribs and flanges defining an L-shaped cross-sectional configuration and the intermediate ones of said ribs and flanges defining a T-shaped cross-sectional configuration, a self coiling tape disposed between each adjacent pair of said ribs and with its edges disposed between said flat planar surface of said support plate and the associated pair of flanges so as slidably to hold the part of each tape adjacent said support plate in a substantially flat planar condition and so as to allow the ends thereof to assume a coiled condition, visually observable indicia on each tape, and a housing structure for said support plate and said tapes.

8. In a manually adjustable indicating device, a flat elongated support plate having a flat planar surface, a plurality of longitudinally spaced transversely disposed ribs on said support plate, a plurality of flanges on the edges of said ribs remote from said support plate respectively, a self coiling tape disposed between each adjacent pair of said ribs and with the flanges arranged in overlapping relation with the side edges of each tape and in contact with said flat planar surface so as slidably to hold the part of each tape adjacent said support plate in a substantially flat planar condition and so as to allow the ends thereof to assume a coiled condition, visually observable indicia on each tape, and a housing structure for said support plate and said tapes.

* * * * *